US009211461B2

(12) United States Patent
Marciano

(10) Patent No.: US 9,211,461 B2
(45) Date of Patent: Dec. 15, 2015

(54) ACCESSORY FOR A HOCKEY GOALIE BLOCKER PAD

(71) Applicant: Marco Marciano, Boisbriand (CA)

(72) Inventor: Marco Marciano, Boisbriand (CA)

( * ) Notice: Subject to any disclaimer, the term of this patent is extended or adjusted under 35 U.S.C. 154(b) by 116 days.

(21) Appl. No.: 13/916,769

(22) Filed: Jun. 13, 2013

(65) Prior Publication Data

US 2014/0371007 A1 Dec. 18, 2014

(51) Int. Cl.

| | |
|---|---|
| ***A63B 71/12*** | (2006.01) |
| ***A63B 71/08*** | (2006.01) |
| ***A63B 69/00*** | (2006.01) |
| ***A63B 71/14*** | (2006.01) |
| ***A63B 43/00*** | (2006.01) |

(52) U.S. Cl.

CPC ..... *A63B 69/0026* (2013.01); *A63B 43/005* (2013.01); *A63B 71/12* (2013.01); *A63B 71/14* (2013.01); *A63B 71/1225* (2013.01); *A63B 2209/10* (2013.01)

(58) Field of Classification Search

CPC ..... A63B 69/0026; A63B 69/0024; A63B 2243/0041; A63B 2243/0045; A63B 59/14; A63B 71/143

USPC ..... 473/446, 450, 458, 464, 438, 451, 470, 473/573, 588, 518; 446/46; 273/348.4, 273/DIG. 30; 2/161.1, 16, 20

See application file for complete search history.

(56) References Cited

U.S. PATENT DOCUMENTS

| | | | | | |
|---|---|---|---|---|---|
| 1,158,208 | A | * | 10/1915 | Hart | 2/22 |
| 3,885,249 | A | * | 5/1975 | De Brabander | 2/161.6 |
| 4,017,076 | A | * | 4/1977 | Bai | 273/348.4 |
| 4,042,975 | A | * | 8/1977 | Elliott et al. | 2/161.1 |
| 4,700,404 | A | * | 10/1987 | Potvin | 2/16 |
| 4,789,161 | A | * | 12/1988 | Waskelo | 473/514 |
| 4,836,554 | A | | 6/1989 | Robbins | |
| 4,995,617 | A | | 2/1991 | Lee | |
| 5,082,291 | A | * | 1/1992 | Appel et al. | 273/348.4 |
| 5,107,544 | A | * | 4/1992 | Capatosto | 2/16 |
| 5,209,490 | A | * | 5/1993 | Dallavecchia | 273/348.4 |
| 5,213,324 | A | * | 5/1993 | Bowers | 473/457 |
| 5,218,718 | A | * | 6/1993 | Chih | 2/16 |
| 5,320,359 | A | * | 6/1994 | Harwell et al. | 273/DIG. 30 |
| 5,530,967 | A | * | 7/1996 | Cielo | 2/16 |
| 5,564,122 | A | * | 10/1996 | Wagner | 2/16 |
| 5,617,580 | A | * | 4/1997 | DiCesare et al. | 2/22 |
| 5,655,221 | A | * | 8/1997 | Worischeck | 2/16 |
| D385,667 | S | * | 10/1997 | Goldsmith | D29/116.3 |
| 6,105,162 | A | | 8/2000 | Douglas et al. | |
| 6,701,530 | B2 | * | 3/2004 | Kleinert | 2/161.1 |
| 2002/0040494 | A1 | * | 4/2002 | Kleinert | 2/161.1 |
| 2009/0106875 | A1 | * | 4/2009 | Christopher | 2/161.1 |

FOREIGN PATENT DOCUMENTS

| | | | | | |
|---|---|---|---|---|---|
| CA | 2261737 | | | 2/1998 | |
| CA | 2253057 | A1 | * | 5/2000 | A63B 71/14 |
| EP | 0507418 | | | 7/1992 | |
| EP | 0507418 | A2 | * | 10/1992 | A63B 59/02 |
| WO | WO 2007035773 | A2 | * | 3/2007 | A63B 71/14 |

* cited by examiner

*Primary Examiner* — Mitra Aryanpour

(57) ABSTRACT

A hockey goalie blocker pad for use with a hockey goalie blocker. The blocker pad has a substantially rectangular volume having four sides, a top surface, and a bottom surface opposite the top surface; the bottom surface has a curved shape adapted to coincide with the curved shape of a top surface of the goalie blocker, to thereby fit snugly there against. The top surface is substantially flat and includes a hook surface including hook material thereon and adapted to interact with a surface of a practice hockey ball having loop material thereon, and a connector member adapted to securely and removably attach the blocker pad to the blocker.

6 Claims, 4 Drawing Sheets

FIG. 2a
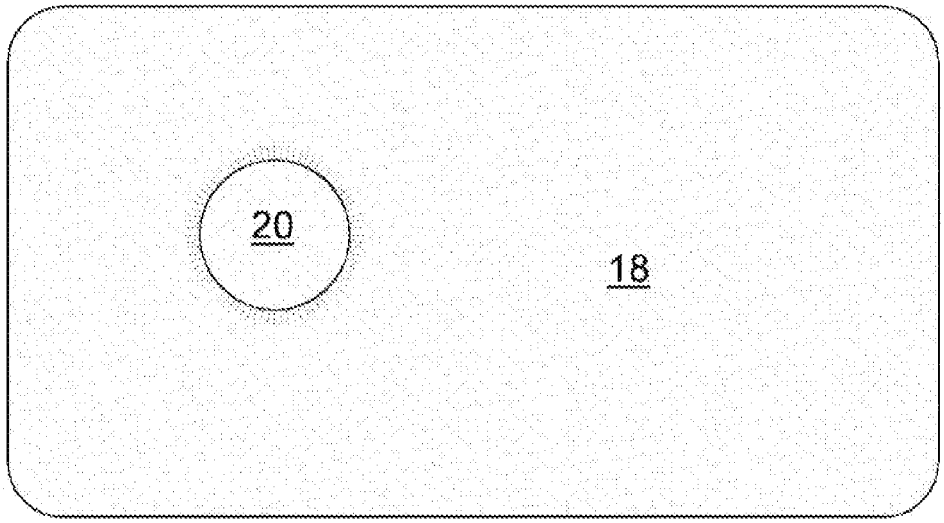
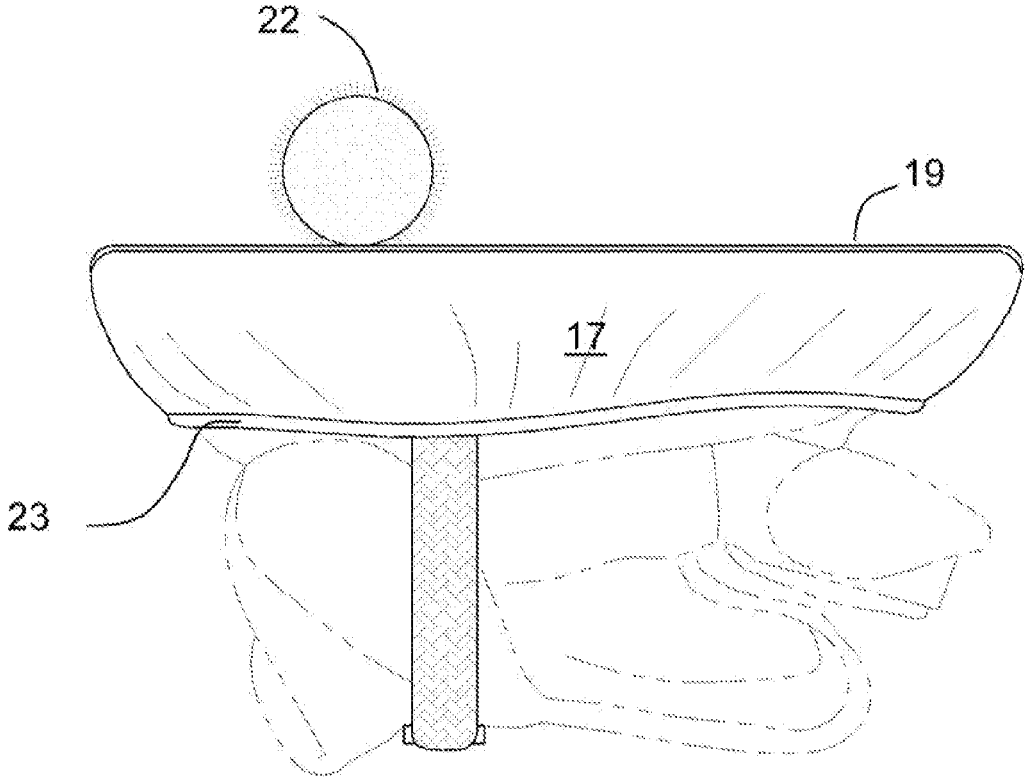
FIG. 2b

ACCESSORY FOR A HOCKEY GOALIE BLOCKER PAD

This application claims priority based on request GB1210507.8 filed Jun. 13, 2012 Accessory for a hockey goalie blocker pad.

FIELD OF THE INVENTION

The present invention relates generally to sports equipment but more particularly to an accessory for training a hockey goalie to develop better reflexes for using his blocker pad.

BACKGROUND OF THE INVENTION

When a hockey puck hits the blocker, it has a relatively limited bounce. The goalie usually makes a save by deflecting the puck in the corner or holding on to it and waiting for a referee to blow his whistle. The problem is that when training goalies, a racket ball is used for training the mitt side of the goalie. This is easy to do since the mitt is designed to grab and hold, but when it comes to training the blocker side, the racketball bounces and rolls off all direction. This makes it hard for the goalie or the trainer to have to chase the ball and start again while keeping the focus on the training exercise.

SUMMARY OF THE INVENTION

In view of the foregoing disadvantages inherent in the known devices now present in the prior art, the present invention, which will be described subsequently in greater detail, is to provide objects and advantages which are:

To provide for an easy way to eliminate the problem of rolling balls and the use of another individual (coach).

In order to do so, the invention consists in a hockey goalie blocker pad for use with a hockey goalie blocker. The blocker pad has a substantially rectangular volume having four sides, a top surface, and a bottom surface opposite the top surface; the bottom surface has a curved shape adapted to coincide with the curved shape of a top surface of the goalie blocker, to thereby fit snugly there against. The top surface is substantially flat and includes a hook surface including hook material thereon and adapted to interact with a surface of a practice hockey ball having loop material thereon, and a connector member adapted to securely and removably attach the blocker pad to the blocker.

The hockey goalie blocker is further comprised of a skirt member covering the four sides of the blocker pad.

The rectangular volume is filled with a material chosen from a list of materials including plastic, expanded polystyrene foam, rubber, and gels.

The connector member is formed from as a belt comprising two straps, one strap connected to one of the four sides and including a male connector member thereon, and a second strap connected to an opposite side of the one of the four sides and including a female connector member thereon, and adapted such that the belt can wrap around the goalie blocker and releasably attach thereto by removably connecting the female connector member to the male connector member.

The one strap including the male connector member is adjustable in length.

The skirt member includes a draw string adapted to snugly fit the skirt member around the four sides of the rectangular volume.

The hockey goalie blocker pad has the rectangular volume, the top surface, and the skirt member formed as separate members, such that the skirt member is attached to the rectangular volume, and the top surface is attached to the rectangular volume with the skirt member therebetween.

The hockey goalie blocker pad is used in combination with a hockey goalie blocker, as well as in combination with both a goalie blocker and a hockey ball.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

BRIEF DESCRIPTION OF THE DRAWINGS

FIGS. 2*a-b* Top and side views of the invention.

DETAILED DESCRIPTION OF THE PREFERRED EMBODIMENT

Figure 1:
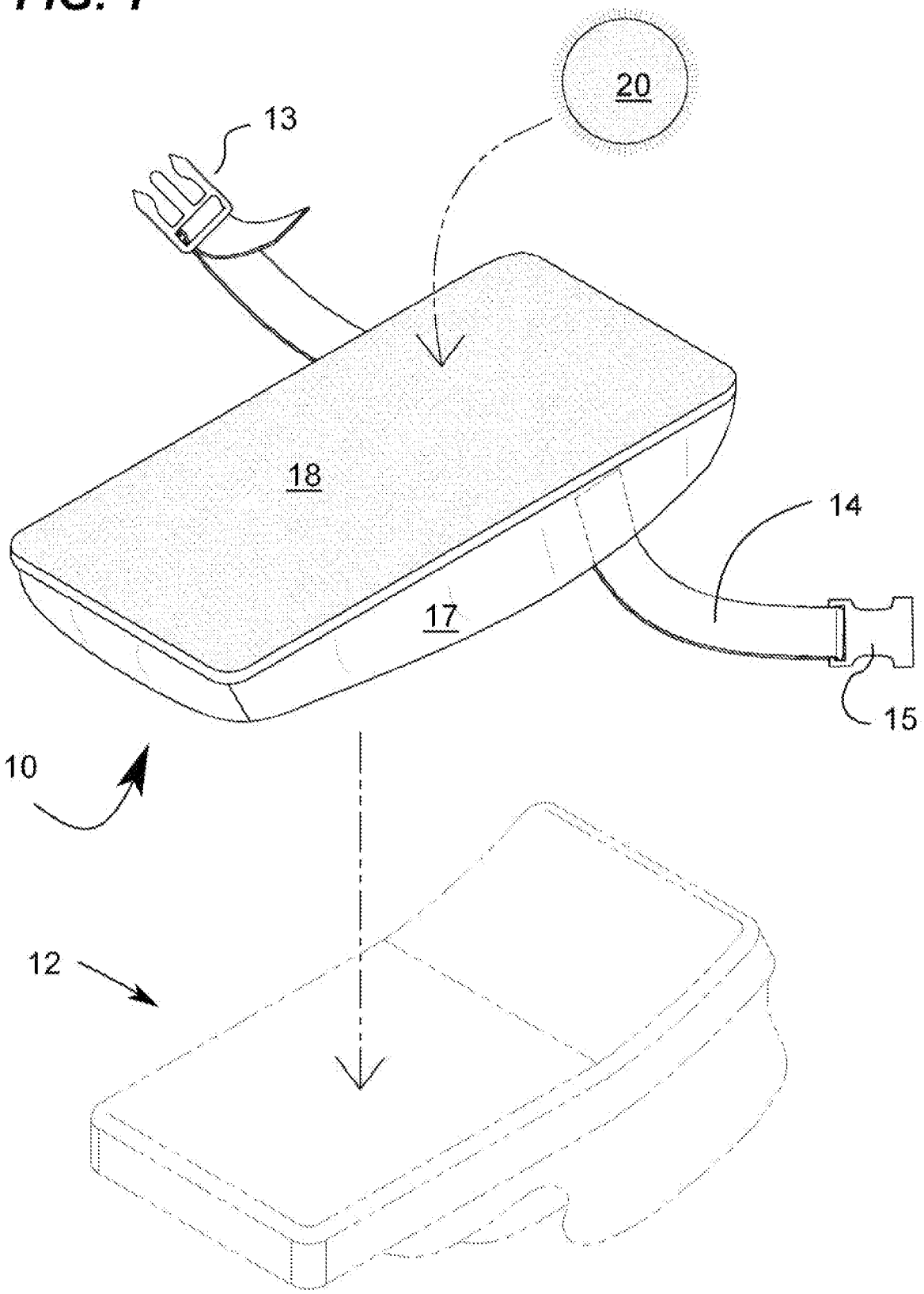
FIG. 1 Isometric view of the invention above a blocker.
Figure 3:
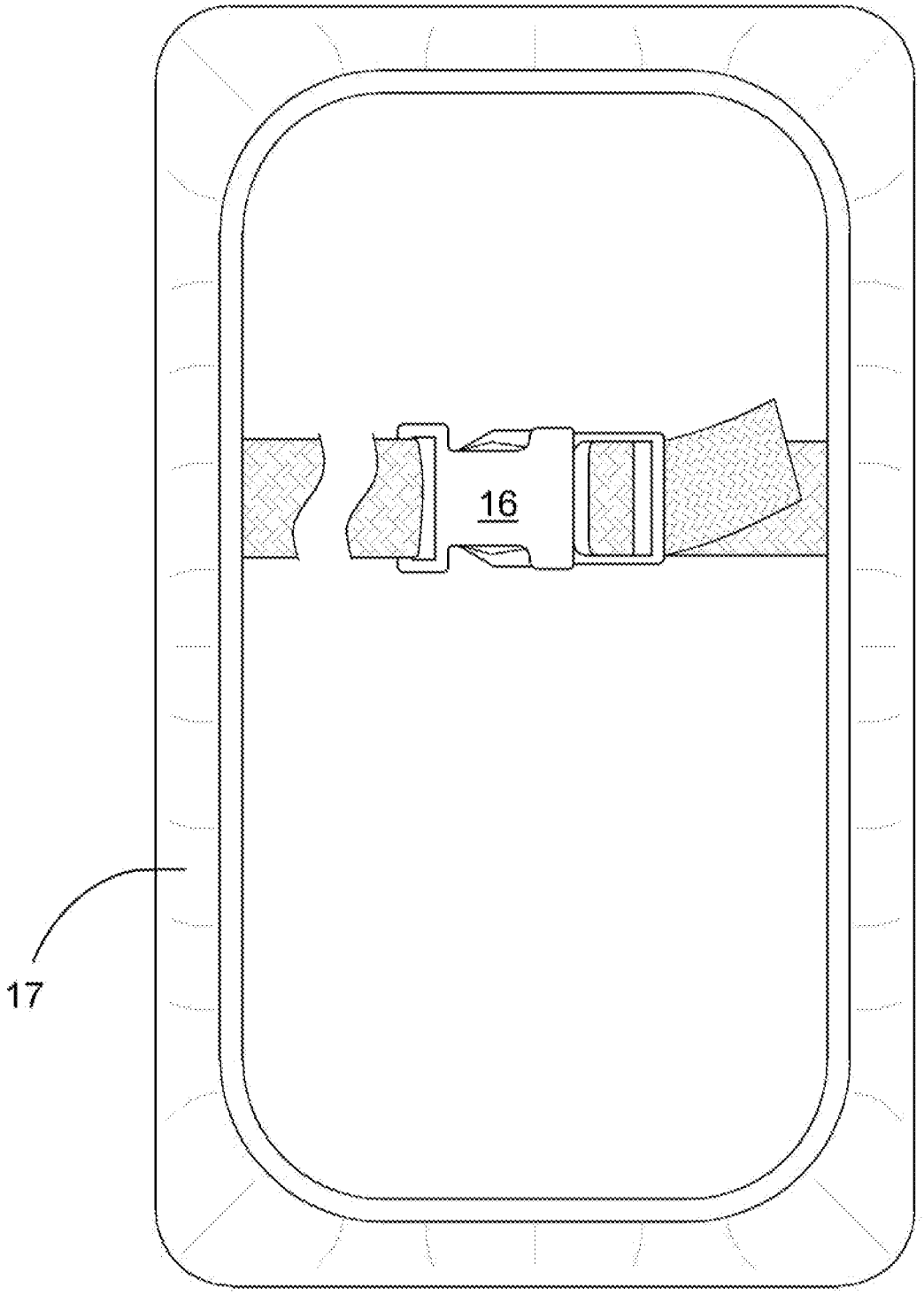
FIG. 3 Bottom view of the invention.
Figure 4:
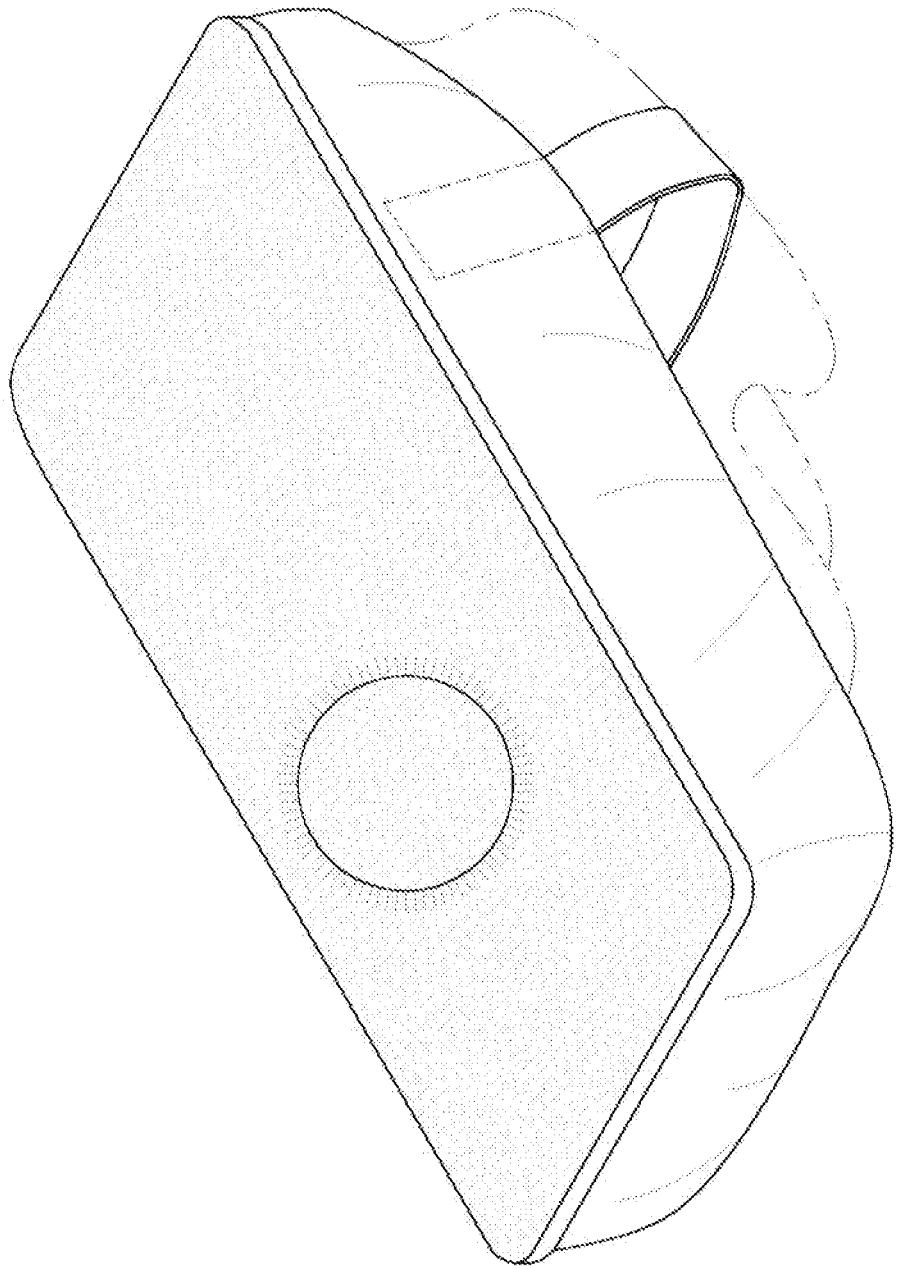
FIG. 4 Isometric view of the invention installed on a blocker and with a ball.

A hockey goalie blocker pad (10) for covering a hockey goalie blocker (12) has an adjustable belt (14) with a clip (16) having a male and a female connector (13, 15), a skirt (17) to cover the sides of the blocker (12) and a planar surface (18) configured and sized to cover the entire surface of the blocker (12). The planar surface (18) is made out of a hook surface (19) and works best with a ball (20) that has a deep pile (22), such as a tennis ball for example, so that it operates like typical hoop and pile material such as Velcro™. A draw string (23) adjusts the skirt (17) to the contour of the blocker (12).

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A hockey goalie training device for aiding a goalie to develop better reflexes, the training device including in combination:

a goalie blocker, said goalie blocker substantially rectangular in shape and including a curved upper surface, a lower surface, four sides, and an interior volume therebetween for receiving a hand of a goalie;

a goalie blocker pad, having a shape conforming substantially to the rectangular shape of the goalie blocker, said blocker pad further including a volume having four sides, a planar upper surface, and a curved lower surface opposite said upper surface, said volume adapted to absorb energy transferred from a hockey ball during use; and a hockey ball, said hockey ball including an outer surface having loop material thereon;

wherein said curved lower surface of said goalie blocker pad conforms to said curved upper surface of said goalie blocker, to thereby fit snugly there against and substantially cover said goalie blocker;

wherein said upper surface of said goalie blocker includes hook material thereon, said hook material interacts with the loop material on said hockey ball;

wherein said blocker pad further comprises a connector member for securely and removably attaching said blocker pad to said goalie blocker, and wherein during use, said loop material on the hockey ball releasably attaches to said hook material on said upper planar surface of said blocker pad, such that when using the combination of said goalie blocker and said blocker pad together, a goalie can block said hockey ball and prevent said hockey ball from rebounding away from the goalie.

2. The hockey goalie training device of claim 1, wherein said four sides of said blocker pad further comprises a skirt member.

3. The hockey goalie training device of claim 1, wherein said connector member is a belt comprising two straps, a first strap connected to one of said four sides and including a male connector member thereon, and a second strap connected to an opposite side of said one of said four sides and including a female connector member thereon, and adapted such that said belt can wrap around said goalie blocker and releasably attach thereto by removably connecting said female connector member to said male connector member.

4. The hockey goalie training device of claim 3, wherein said first strap is adjustable in length.

5. The hockey goalie training device of claim 2, wherein said skirt member includes a draw string adapted to snugly fit said skirt member around said four sides of said rectangular volume of said goalie blocker.

6. The hockey goalie training device of claim 2, wherein said rectangular volume of said blocker pad, and said skirt member are formed as separate members, such that said skirt member is attached to said rectangular volume, and said top surface is attached to said rectangular volume with the skirt member therebetween.

* * * * *